US010190408B2

(12) United States Patent
Roberts

(10) Patent No.: US 10,190,408 B2
(45) Date of Patent: Jan. 29, 2019

(54) SYSTEM, APPARATUS, AND METHOD FOR DRILLING

(71) Applicant: APS Technology, Inc., Wallingford, CT (US)

(72) Inventor: Andrew Roberts, Meriden, CT (US)

(73) Assignee: APS Technology, Inc., Wallingford, CT (US)

( * ) Notice: Subject to any disclaimer, the term of this patent is extended or adjusted under 35 U.S.C. 154(b) by 576 days.

(21) Appl. No.: 14/087,637

(22) Filed: Nov. 22, 2013

(65) Prior Publication Data

US 2015/0145687 A1 May 28, 2015

(51) Int. Cl.
*E21B 47/12* (2012.01)

(52) U.S. Cl.
CPC ..... *E21B 47/122* (2013.01)

(58) Field of Classification Search
None
See application file for complete search history.

(56) References Cited

U.S. PATENT DOCUMENTS

| | | | | |
|---|---|---|---|---|
| 2,225,668 | A | 12/1940 | Subkow | |
| 3,411,584 | A | 11/1968 | Sizer et al. | |
| 3,518,609 | A | 6/1970 | Fontenot, Jr. | |
| 3,765,494 | A | 10/1973 | Kielman, Jr. | |
| 4,066,128 | A | 1/1978 | Davis | |
| 4,130,162 | A | 12/1978 | Nelson | |
| 4,160,970 | A * | 7/1979 | Nicolson | E21B 47/122 166/66 |
| 4,216,536 | A | 8/1980 | More | |
| 4,348,682 | A | 9/1982 | Givler | |
| 4,416,330 | A | 11/1983 | Merritt | |

(Continued)

FOREIGN PATENT DOCUMENTS

| | | | |
|---|---|---|---|
| CA | 2760931 | A1 | 6/2013 |
| CA | 2786471 | A1 | 7/2013 |

(Continued)

OTHER PUBLICATIONS

U.S. Appl. No. 14/627,806, filed Feb. 20, 2015, David David Cramer.

(Continued)

*Primary Examiner* — Chico A Foxx
(74) *Attorney, Agent, or Firm* — Offit Kurman, P.A.; Gregory A. Grissett

(57) ABSTRACT

A system, apparatus and method for monitoring a drilling operation includes receiving a signal via a first pair of antennas positioned on a surface of the earthen formation. The signal received by the first pair of antennas has a first signal characteristic. The method includes receiving the signal via a second pair of antennas positioned on the surface at a different location than that of the first pair of antennas. The signal received by the second pair of antennas has a second signal characteristic. The method includes identifying which of the first signal characteristic and the second signal characteristic of the signal received by the respective first and second pairs of antennas is a preferred signal characteristic. The method can include decoding the signal received by one of the first and second pairs of antennas that has received the signal with the preferred signal characteristic.

47 Claims, 8 Drawing Sheets

(56) References Cited

U.S. PATENT DOCUMENTS 4,630,243 A 12/1986 Macleod
4,689,775 A 8/1987 Scherbatskoy
4,825,946 A 5/1989 Schnatzmeyer
4,980,682 A * 12/1990 Klein ..... E21B 47/122 166/66
5,189,415 A 2/1993 Shimada
5,328,685 A 7/1994 Janchitraponvej
5,463,313 A 10/1995 Berkan
5,782,261 A 7/1998 Becker
5,818,352 A 10/1998 McClure
5,955,884 A * 9/1999 Payton ..... G01V 3/26 324/339
5,959,548 A 9/1999 Smith
6,018,602 A 1/2000 Smith
6,111,409 A 8/2000 Edwards
6,364,035 B2 * 4/2002 Brune ..... B82Y 25/00 175/202
6,367,323 B1 4/2002 Camwell et al.
6,411,078 B1 6/2002 Nakagawa
6,417,666 B1 * 7/2002 Mercer ..... E21B 47/02216 175/45
6,470,274 B1 10/2002 Mollison
6,531,871 B1 3/2003 Hay
6,657,597 B2 12/2003 Rodney
6,810,955 B2 11/2004 Roth
6,896,050 B2 5/2005 Biglin, Jr. et al.
6,915,849 B2 7/2005 Nuth
7,151,466 B2 12/2006 Gabelmann
7,170,423 B2 * 1/2007 Wisler ..... E21B 47/122 340/853.7
7,178,608 B2 2/2007 Mayes
7,204,309 B2 4/2007 Segura
7,213,607 B2 5/2007 De Almeida
7,243,028 B2 7/2007 Young
7,296,639 B2 11/2007 Millar et al.
7,327,144 B2 * 2/2008 Brune ..... E21B 47/02 175/45
RE40,321 E * 5/2008 Srnka ..... G01V 3/12 324/354
7,480,207 B2 * 1/2009 Marsh ..... E21B 47/182 340/853.1
7,506,699 B1 3/2009 Harvey et al.
7,506,700 B1 3/2009 Harvey et al.
7,681,663 B2 3/2010 Cobern
7,775,301 B2 * 8/2010 Brune ..... E21B 47/02224 175/26
7,832,503 B2 11/2010 Sand et al.
8,069,931 B2 12/2011 Hooks
8,154,420 B2 4/2012 Petrovic et al.
8,284,073 B2 10/2012 Mehta et al.
8,400,326 B2 3/2013 Codazzi
8,464,798 B2 6/2013 Nadkrynechny
8,474,548 B1 7/2013 Young
8,952,700 B2 * 2/2015 Wisler ..... E21B 47/02216 175/45
9,196,411 B2 11/2015 Parsche
9,234,981 B2 1/2016 Rodney et al.
9,274,243 B2 3/2016 Chau et al.
9,291,049 B2 * 3/2016 Switzer ..... E21B 47/122
9,303,465 B2 4/2016 Pare et al.
9,328,603 B2 5/2016 Pope
9,453,397 B2 9/2016 Dowling et al.
9,562,987 B2 2/2017 Guner et al.
9,575,201 B2 2/2017 Wang
2002/0170711 A1 11/2002 Nuth
2003/0025639 A1 * 2/2003 Rodney ..... G01V 11/002 343/719
2004/0004553 A1 1/2004 Rodney
2004/0035575 A1 2/2004 Roth
2004/0104047 A1 6/2004 Peter
2004/0156264 A1 8/2004 Gardner
2004/0169367 A1 9/2004 Sutherland et al.
2004/0226749 A1 11/2004 Biglin, Jr. et al.
2005/0016771 A1 1/2005 Mayes et al.
2005/0046587 A1 3/2005 Wisler
2005/0061369 A1 3/2005 De Almeida
2005/0140373 A1 * 6/2005 Li ..... G01V 3/30 324/338
2006/0035591 A1 * 2/2006 Young ..... E21B 47/12 455/63.1
2006/0041795 A1 * 2/2006 Gabelmann ..... G01V 11/002 714/699
2006/0062428 A1 * 3/2006 Alattar ..... G06T 1/005 382/100
2006/0118298 A1 6/2006 Millar et al.
2006/0124354 A1 6/2006 Witte
2006/0202852 A1 9/2006 Peter
2007/0239403 A1 * 10/2007 Hornbostel ..... G01V 3/083 702/191
2007/0247328 A1 * 10/2007 Petrovic ..... G01V 11/002 340/853.7
2007/0251729 A1 11/2007 Sand et al.
2009/0261986 A1 10/2009 Mehta
2010/0258351 A1 10/2010 Hooks
2010/0262370 A1 * 10/2010 Bittar ..... G01V 11/002 702/6
2010/0305864 A1 * 12/2010 Gies ..... E21B 47/01 702/9
2011/0001633 A1 * 1/2011 Lam ..... G01R 29/26 340/853.1
2011/0017512 A1 1/2011 Codazzi
2011/0061864 A1 3/2011 Umphries et al.
2011/0253382 A1 10/2011 Nadkrynechny
2011/0304220 A1 12/2011 Whitehead
2012/0126992 A1 5/2012 Rodney
2012/0300584 A1 * 11/2012 Eick ..... G01V 1/345 367/73
2013/0009646 A1 * 1/2013 Simon ..... G01V 3/30 324/338
2013/0014992 A1 1/2013 Sharp
2013/0077440 A1 * 3/2013 Cao ..... G01V 1/28 367/73
2013/0140019 A1 6/2013 Pare et al.
2013/0169278 A1 * 7/2013 Bittar ..... G01V 3/30 324/338
2013/0176139 A1 7/2013 Chau et al.
2013/0241561 A1 * 9/2013 Allen ..... G01V 3/28 324/338
2013/0241742 A1 * 9/2013 Contant ..... E21B 47/122 340/854.6
2013/0265171 A1 10/2013 Hay
2014/0032116 A1 * 1/2014 Guner ..... G01V 3/30 702/6
2014/0041863 A1 2/2014 Dowling et al.
2014/0048332 A1 2/2014 Schmidt et al.
2014/0110395 A1 4/2014 Parsche
2014/0240140 A1 * 8/2014 Switzer ..... E21B 47/122 340/854.6
2015/0053485 A1 2/2015 Altimas et al.
2015/0145687 A1 5/2015 Roberts
2015/0218938 A1 8/2015 Weisbeck et al.
2015/0247401 A1 9/2015 Cramer
2015/0276970 A1 * 10/2015 Wu ..... G01V 3/38 702/7
2015/0293254 A1 10/2015 Wang
2015/0337650 A1 11/2015 Balogh
2016/0003035 A1 * 1/2016 Logan ..... E21B 47/12 340/854.6
2016/0138388 A1 5/2016 Chau et al.
2016/0146000 A1 5/2016 Logan et al.
2016/0245068 A1 8/2016 David Cramer et al.
2016/0290066 A1 10/2016 Frith
2016/0369615 A1 12/2016 Cune et al.

FOREIGN PATENT DOCUMENTS

EP 0 911 484 4/1999
EP 0 913 555 5/1999
EP 0 922 836 6/1999
GB 2 008 899 6/1979
WO WO 2006-028701 3/2006

(56) References Cited

FOREIGN PATENT DOCUMENTS

| | | | |
|---|---|---|---|
| WO | WO2006028701 | A2 | 3/2006 |
| WO | WO2012175658 | A2 | 6/2012 |
| WO | WO 2012-175658 | | 12/2012 |

OTHER PUBLICATIONS

Gvelasco Quesada, Novel Advances in Microsystems Technologies and Their Applications, CRCPress, Chapter21, Aug. 2013, p. 348, 3 pages.

International Patent Application No. PCT/US2014/066801; Notification of Transmittal of the International Search Report and the Written Opinion of the International Searching Authority dated Jul. 21, 2015, 16 pages.

International Patent Application No. PCT/US2015/018249; Notification of Transmittal of the International Search Report and the Written Opinion of the International Searching Authority dated May 21, 2015, 10 pages.

International Patent Application No. PCT/US2015/031467; Notification of Transmittal of the International Search Report and the Written Opinion of the International Searching Authority dated Aug. 19, 2015, 8 pgs.

* cited by examiner

SYSTEM, APPARATUS, AND METHOD FOR DRILLING

TECHNICAL FIELD

The present disclosure relates to a drilling operation, and in particular to a system, apparatus, and method for monitoring a drilling operation.

BACKGROUND

Wells drilled for oil, gas and other purposes may be thousands of feet underground, change direction and extend horizontally. Communication systems have been developed that transmit information regarding the well path, formation properties, and drilling conditions measured with sensors at or near the drill bit. Obtaining and transmitting information is commonly referred to as measurement-while-drilling (MWD) and logging-while-drilling (LWD). One transmission technique is electromagnetic (EM) telemetry or telemetry. Telemetry systems include tools that are configured to transmit an electromagnetic signal to the surface having encoded therein directional, formation and other drilling data obtained during the drilling operation.

SUMMARY

An embodiment of the present disclosure includes a method for monitoring a drilling operation of a drilling system. The drilling system has a drill string configured to form a borehole in an earthen formation during the drilling operation. The method includes the step of receiving a signal via a first pair of antennas positioned on a surface of the earthen formation, the signal being transmitted by a telemetry tool supported by the drill string and being located at a downhole end of the borehole during the drilling operation. The signal received by the first pair of antennas has a first signal characteristic. The method includes receiving the signal via a second pair of antennas positioned on the surface at a different location than that of the first pair of antennas. The signal received by the second pair of antennas has a second signal characteristic. Further, the method includes identifying which of the first signal characteristic and the second signal characteristic of the signal received by the respective first and second pairs of antennas is a preferred signal characteristic. The method can include decoding the signal received by one of the first and second pairs of antennas that has received the signal with the preferred signal characteristic.

In another embodiment of a method for monitoring a drilling operation, the method can include transmitting a signal from the telemetry tool at a first downhole location in the borehole during a first duration of the drilling operation. The method can further include receiving the signal via at least two antenna pairs. The at least two antenna pairs are positioned on the surface and spaced apart with respect to each other and the borehole. The method can include receiving, during the first duration of the drilling operation, a surface signal from each of the at least two antenna pairs that received the signal. Further, the method can include decoding the surface signal from one of the at least two antenna pairs that received the signal having a preferred signal characteristic.

Another embodiment of present disclosure includes a telemetry system for a drilling operation. The system includes a plurality of antenna pairs, each antenna pair configured to receive a signal that is transmitted by a telemetry tool at a downhole location in the borehole during the drilling operation. The system further includes a receiver assembly configured for electronic connection with each of the plurality of antenna pairs. The receiver assembly is configured to receive a plurality of surface signals from each of the respective plurality of antenna pairs when the receiver assembly is electronically connected to the plurality of antenna pairs. Each surface signal is indicative of characteristics of the signal received by the respective plurality of antenna pairs. Further, the system includes a computer processor that is configured for electronic communication with the receiver assembly. The computer processor is also configured to determine which among the plurality of surface signals have a preferred signal characteristic. In response to the determination of which surface signal has the preferred signal characteristic, the computer processor decodes the surface signal received by one of the plurality of antenna pairs that received the signal with the preferred signal characteristic.

Another embodiment of present disclosure includes a drilling system for forming a borehole in an earthen formation. The drilling system includes a drill string carried by a support member and configured to rotate so as to define the borehole along a drilling direction. The drill string includes a drill bit positioned at the downhole end of the drill string and one or more sensors carried by the drill string. The one or more sensors are configured to obtain drilling data. The drill string can include a telemetry tool positioned in an up-hole direction away from the drill bit. The telemetry tool is configured to transmit the drilling data via a signal. The drilling system can include a first pair of antennas configured to receive the signal and a second pair of antennas configured to receive the signal. The first and second pair of antennas are in different locations relative to the support member. The drilling system can also include a receiver assembly electronically connected to the first and second pair of antennas. The receiver assembly is configured to receive the surface signals from each the first and second pair of antennas. The surface signals are indicative of the signal that has been received by each pair of antennas. Further, the drilling system can include at least one computer processor configured to decode one of the surface signals received by the receiver assembly based on one or more preferred characteristics of the surface signals obtained from each of the first and second pairs of antennas.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1A:
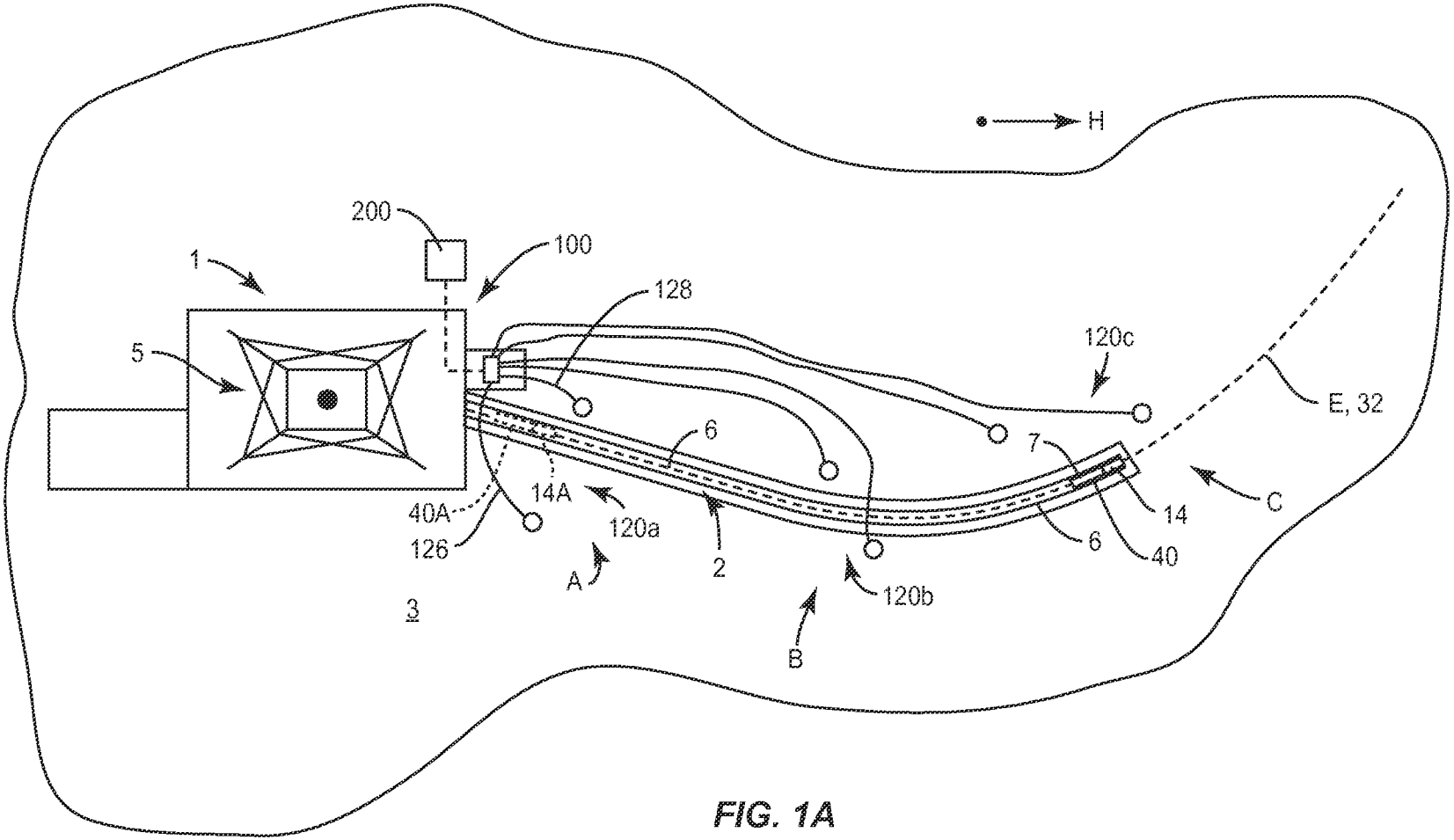
FIG. 1A is a schematic plan view of a drilling system forming a borehole in an earthen formation, according to an embodiment of the present disclosure.
Figure 1B:
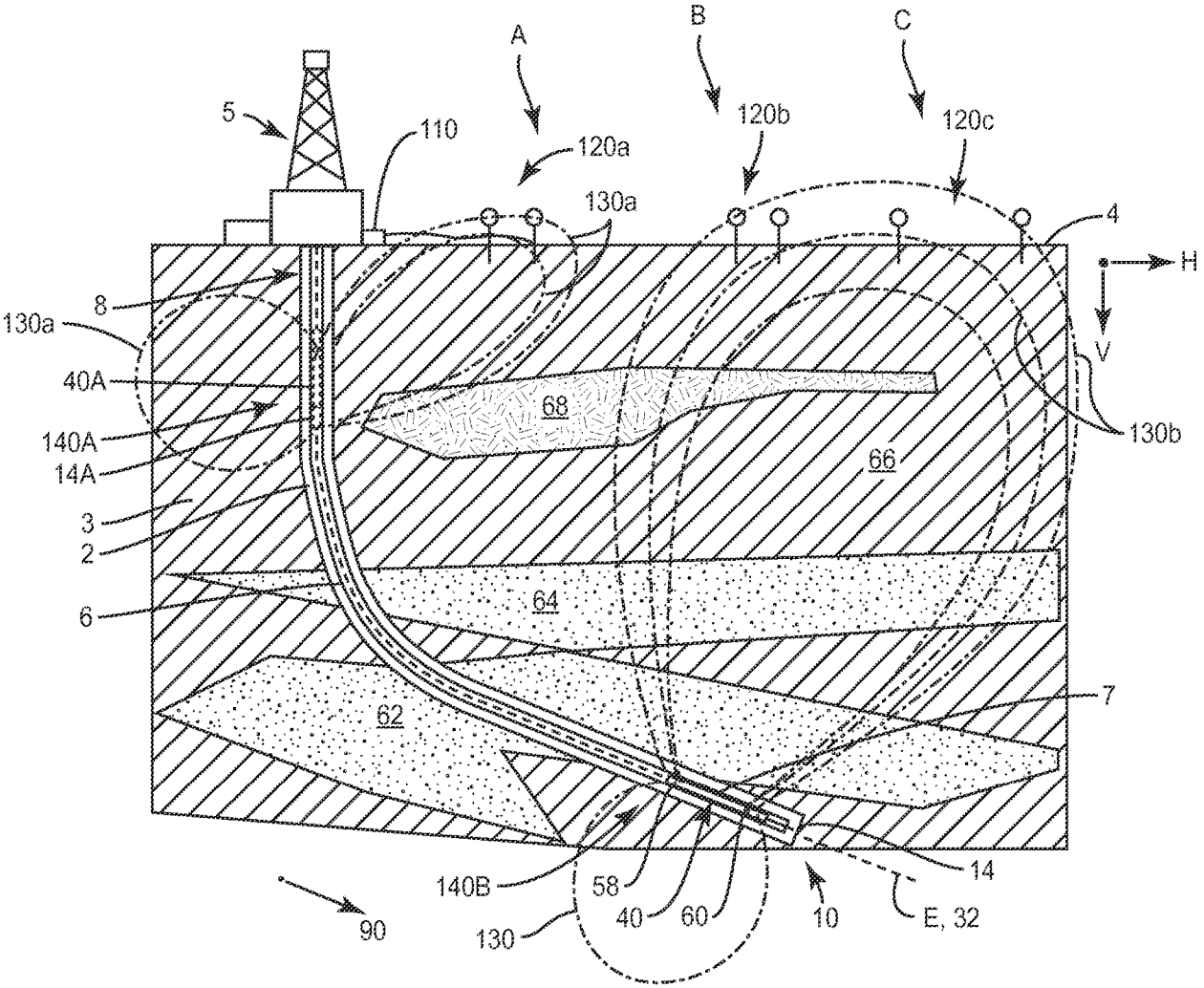
FIG. 1B is a schematic side view of the drilling system forming the borehole in an earthen formation shown in FIG. 1A.

Referring to FIGS. 1A and 1B, the drilling system 1 is configured to drill a borehole 2 in an earthen formation 3 during a drilling operation. The drilling system 1 includes a drill string 6 for forming the borehole 2 in the earthen formation 3, a telemetry system 100 and at least one computing device 200. The telemetry system 100 processes and monitors the transmission of drilling data obtained in a downhole location of the borehole 2 to the surface 4 of the earthen formation 3 via an electromagnetic signal 130. The telemetry system 100 includes a receiver assembly 110 and two or more antenna pairs 120. The receiver assembly 110 can be in electronic communication with the computing device 200. Each antenna pair 120 can receive, for instance, detect an electrical field component of an electromagnetic signal 130 transmitted by a downhole telemetry tool 40 as a voltage or surface signal. The detected surface signal embodies characteristics of the electric field component of the electromagnetic signal 130, such as the amplitude and wavelength components of the electric field. The receiver assembly 110 receives the surface signal from each respective antenna pair 120. The telemetry system 100 is configured to decode into drilling data one surface signal among the plurality of surface signals received by the receiver assembly 110 from the antenna pairs 120. The determination of which surface signal to decode is based in part upon the comparative characteristics of each surface signal detected by respective antenna pairs 120. For instance, only the surface signal detected by the antenna pair 120 that has preferred signal characteristics is decoded, as will be further detailed below.

The computing device 200 can host one or more applications, for instance software applications, that can initiate desired decoding or signal processing, log parameters that indicate the type of formation being drilled through, the presence of liquids, and run other applications that are configured to perform various methods for monitoring and controlling the drilling operation.

The drilling system 1, telemetry system 100 and methods 300 (FIGS. 3A, 3B) and 400 (FIG. 4) as describe here allow continuous monitoring of signals transmitted from the telemetry tool 40 over the course of the drilling operation. While signal characteristics for each antenna pair 120 change over time as drilling progresses into the formation, the telemetry system 100 can "react" to changing signal transmission conditions by switching, at least for decoding purposes, from an antenna pair with poor signal characteristics to an antenna pair with preferred signal characteristics. The ability of monitor and switch among multiple signals has several advantages. For instance, signal quality from multiple antenna pair locations can be monitored in real-time, simultaneously. This allows the drilling operator to utilize the antenna pairs that have the best or preferred signal reception among the multiple antenna pair locations, based on conditions during drilling. Real-time monitoring and signal switching also provides greater flexibility to minimize poor signal reception, which improves data reliability, more reliable decoding and fewer decoding errors. In addition, in marginal signal transmission conditions, the ability to monitor, select, a process signals based on detected signal characteristics can result in better data utilization compared to conventional systems operating in similar marginal transmission conditions. Other advantages will be further detailed below.

Telemetry as used herein refers electromagnetic (EM) telemetry. The telemetry system 100 can be configured to produce, detect, and process an electromagnetic field signal 130. In accordance with the illustrated embodiment, the telemetry system 110 is configured to permit reception and detection of the electrical field component of the electromagnetic field signal 130. In addition, the telemetry system 100 can also be configured to permit reception and detection of the magnetic field component of the electromagnetic field signal 130. Thus, the telemetry tool 40 can be configured to produce an electromagnetic field signal 130, and amplify the electric field component, and alternatively or in addition to, amplify the magnetic field component. Accordingly, the antenna pairs 120 and receiver assembly 110 can be configured to receive, for instance detect, the electric field component of the electromagnetic signal 130. Alternatively or in addition, the antenna pairs 120 and receiver assembly 110 can be configured to receive, for instance detect, the magnetic field component of the electromagnetic signal 130.

Continuing with FIGS. 1A and 1B, according to the illustrated embodiment, the drilling system 1 is configured to drill the borehole 2 in an earthen formation 3 along a borehole axis E such that the borehole axis E extends at least partially along a vertical direction V. The vertical direction V refers to a direction that is perpendicular to the surface 4 of the earthen formation 3. It should be appreciated that the drill string 6 can be configured for directional drilling, whereby all or a portion of the borehole 2 (and thus axis E) is angularly offset with respect to the vertical direction V along a horizontal direction H. The horizontal direction H is at least mostly perpendicular to the vertical direction V so as to be aligned with or parallel to the surface 4. The terms "horizontal" and "vertical" used herein are as understood in the drilling field, and are thus approximations. Thus, the horizontal direction H can extend along any direction that is perpendicular to the vertical direction V, for instance north, east, south and west, as well as any incremental direction between north, east, south and west. Further, downhole or downhole location means a location closer to the bottom end of the drill string 6 than the top end of the drill string 6. Accordingly, a downhole direction 90 (FIGS. 1B and 1C) refers to the direction from the surface 4 toward a bottom end (not numbered) of the borehole 2, while an uphole direction refers the direction from the bottom end of the borehole 2 toward the surface 4. The downhole and uphole directions can be curvilinear for directional drilling operations. Thus, the drilling direction or well path extends partially along the vertical direction V and the horizontal direction H in any particular geographic direction as noted above. An expected drilling direction refers to the direction along which the borehole will be defined in the earthen formation 3. While a directional drilling configuration is shown, the telemetry system 100 can be used with vertical drilling operations and is similarly beneficial in vertical drilling.

Continuing with FIGS. 1A-1D, the drilling system 1 includes a derrick 5 that supports the drill string 6 that extends through and forms the borehole. The drill string 6 includes several drill string components that define the drill string 6 and the internal passage (not shown). Drill string components include one or more subs, stabilizers, drill pipe sections, and drill collars, a bottomhole assembly (BHA) 7, and drill bit 14. The drill string 6 can include the telemetry tool 40 and one or more sensors 42 as further detailed below. The drill string 6 is elongate along a central longitudinal axis 32 and includes a top end 8 and a bottom end 10 spaced from the top end 8 along the central longitudinal axis 32. Located near the surface and surrounding the top end 8 is a casing 12. The bottom end 10 of the drill string 6 includes the drill bit 14. One or more drives, such as a top drive or rotary table, are configured to rotate the drill string 6 so as to control the rotational speed (RPM) of, and torque on, the drill bit 14. The one or more drives (not shown) can rotate the drill string 6 and drill bit 14 to define the borehole 2. A pump is configured to pump a fluid (not shown), for instance drilling mud, drilling with air, foam (or aerated mud), downward through an internal passage (not shown) in the drill string 6. When the drilling mud exits the drill string 6 at the drill bit 14, the returning drilling mud flows upward toward the surface 4 through an annular passage (not shown) formed between the drill string 6 and a wall (not numbered) of the borehole 2 in the earthen formation 3. Optionally, a mud motor may be disposed at a downhole location of the drill string 6 to rotate the drill bit 14 independent of the rotation of the drill string 6.

Figure 2A:
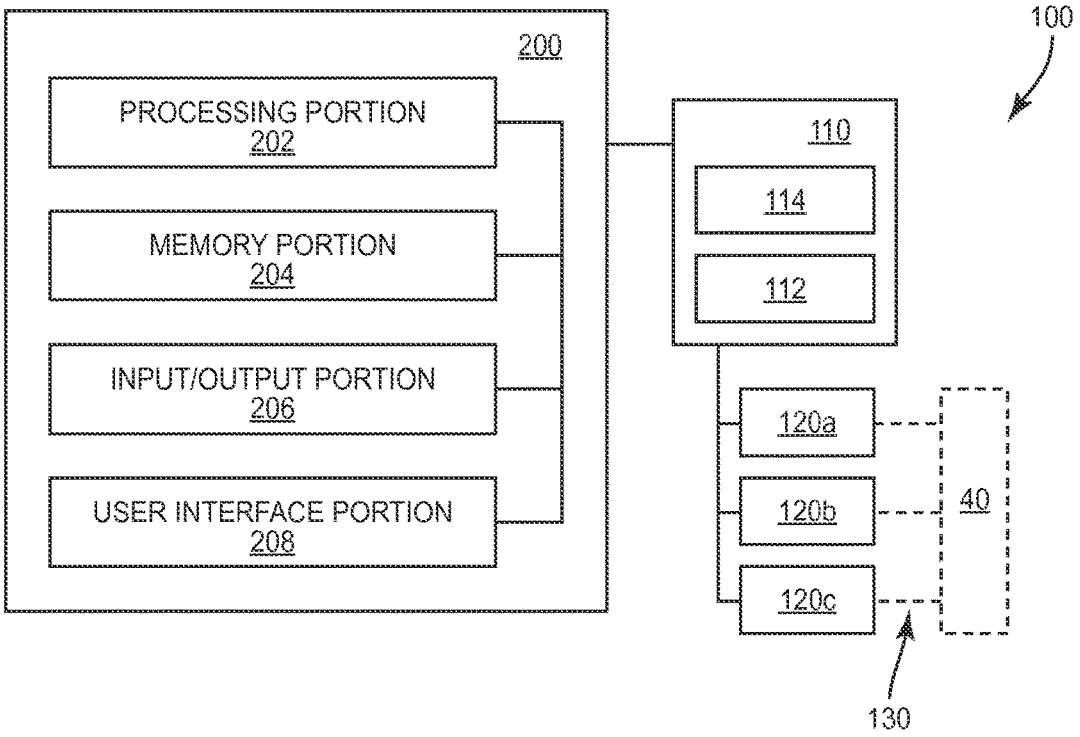
FIG. 2A is a block diagram of a computing device and telemetry system of the drilling system shown in FIGS. 1A and 1B.

Referring to FIG. 2A, as noted above the drilling system can include one or more computing devices 200 in electronic communication with the telemetry system 100. The computing device 200 is configured to receive, process, and store various drilling operation information, such as directional, formation information obtained from the downhole sensors described above. Any suitable computing device 200 may be configured to host a software application for monitoring, controlling and drilling information as described herein. It will be understood that the computing device 200 can include any appropriate device, examples of which include a desktop computing device, a server computing device, or a portable computing device, such as a laptop, tablet or smart phone. In an exemplary configuration illustrated in FIG. 2A, the computing device 200 includes a processing portion 202, a memory portion 204, an input/output portion 206, and a user interface (UI) portion 208. It is emphasized that the block diagram depiction of the computing device 200 is exemplary and not intended to imply a specific implementation and/or configuration. The processing portion 202, memory portion 204, input/output portion 206 and user interface portion 208 can be coupled together to allow communications therebetween. As should be appreciated, any of the above components may be distributed across one or more separate devices and/or locations.

In various embodiments, the input/output portion 206 includes a receiver of the computing device 200, a transmitter (not to be confused with components of the telemetry tool 40 described below) of the computing device 200, or an electronic connector for wired connection, or a combination thereof. The input/output portion 206 is capable of receiving and/or providing information pertaining to communication with a network such as, for example, the Internet. As should be appreciated, transmit and receive functionality may also be provided by one or more devices external to the computing device 200. For instance, the input/output portion 206 can be in electronic communication with the receiver assembly 110.

Depending upon the exact configuration and type of processor, the memory portion 204 can be volatile (such as some types of RAM), non-volatile (such as ROM, flash memory, etc.), or a combination thereof. The computing device 200 can include additional storage (e.g., removable storage and/or non-removable storage) including, but not limited to, tape, flash memory, smart cards, CD-ROM, digital versatile disks (DVD) or other optical storage, magnetic cassettes, magnetic tape, magnetic disk storage or other magnetic storage devices, universal serial bus (USB) compatible memory, or any other medium which can be used to store information and which can be accessed by the computing device 200.

The computing device 200 can contain the user interface portion 208, which can include an input device and/or display (input device and display not shown), that allows a user to communicate with the computing device 200. The user interface 208 can include inputs that provide the ability to control the computing device 200, via, for example, buttons, soft keys, a mouse, voice actuated controls, a touch screen, movement of the computing device 200, visual cues (e.g., moving a hand in front of a camera on the computing device 200), or the like. The user interface 208 can provide outputs, including visual information, such as the visual indication of the plurality of operating ranges for one or more drilling parameters via the display 213 (not shown). Other outputs can include audio information (e.g., via speaker), mechanically (e.g., via a vibrating mechanism), or a combination thereof. In various configurations, the user interface 208 can include a display, a touch screen, a keyboard, a mouse, an accelerometer, a motion detector, a speaker, a microphone, a camera, or any combination thereof. The user interface 208 can further include any suitable device for inputting biometric information, such as, for example, fingerprint information, retinal information, voice information, and/or facial characteristic information, for instance, so to require specific biometric information for access to the computing device 200.

Figure 2B:
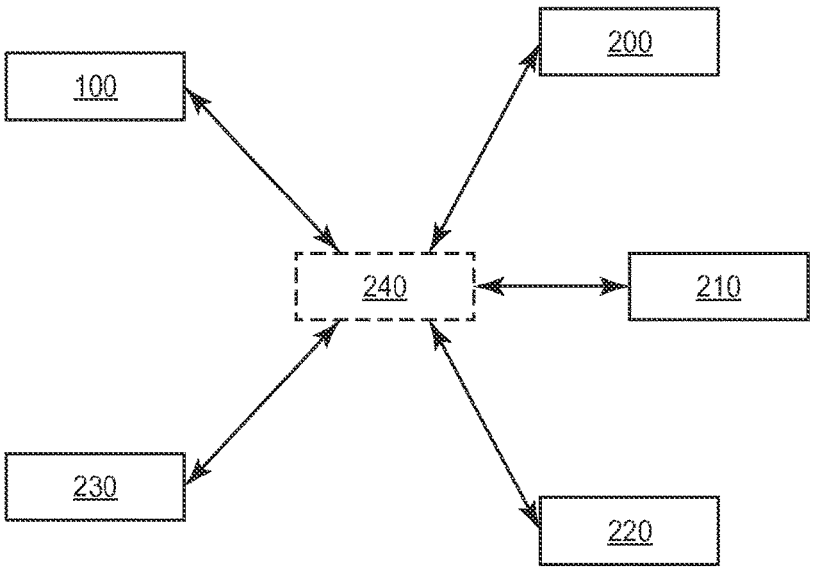
FIG. 2B is a block diagram illustrating a network of one or more computing devices and the telemetry system shown in FIGS. 1A and 1B.

Referring to FIG. 2B, an exemplary and suitable communication architecture is shown that can facilitate monitoring a drilling operation of the drilling system 1. Such an exemplary architecture can include one or more computing devices 200, 210 and 220 each of which can be in electronic communication with a database 230 and the telemetry system 100 via common communications network 240. The database 230, though schematically represented separate from the computing device 200 could also be a component of the memory portion 204 of the computing device 200. It should be appreciated that numerous suitable alternative communication architectures are envisioned. Once the drilling control and monitoring application has been installed onto the computing device 200, such as described above, it can transfer information between other computing devices on the common network 240, such as, for example, the Internet. For instance configuration, a user 24 may transmit, or cause the transmission of information via the network 240 regarding one or more drilling parameters to the computing device 210 of a supplier of the telemetry tool 40, or alternatively to computing device 220 of another third party, e.g., oil company or oil services company, via the network 240. The third party can view, via a display, the drilling data.

The computing device 200 and the database 230 depicted in FIG. 2B may be operated in whole or in part by, for example, a rig operator at the drill site, a drill site owner, drilling company, and/or any manufacturer or supplier of drilling system components, or other service provider, such as a third party providing drill string design service. As should be appreciated, each of the parties set forth above and/or other relevant parties may operate any number of respective computers and may communicate internally and externally using any number of networks including, for example, wide area networks (WAN's) such as the Internet or local area networks (LAN's). Database 230 may be used, for example, to store data regarding one or more drilling parameters, the plurality of operating ranges from a previous drill run, a current drill run, data concerning the models for the drill string components, models for EM performance, and EM performance data from prior wells in the vicinity of the drill site. Such information can provide an indication of what EM parameters, such as frequency and power requirements at different depths and formations that are suitable for given drilling operation. Further it should be appreciated that "access" or "accessing" as used herein can include retrieving information stored in the memory portion of the local computing device, or sending instructions via the network to a remote computing device so as to cause information to be transmitted to the memory portion of the local computing device for access locally. In addition or alternatively, accessing can including accessing information stored in the memory portion of the remote computing device.

Returning to FIGS. 1A-1C, the telemetry tool 40 is sometimes referred to herein as a MWD tool, although the telemetry tool 40 can be a LWD tool. The telemetry tool 40 can also be referred to as an EM transmitter. The telemetry tool 40 is positioned in a downhole location of the drill string 6 toward the drill bit 14 and can be mounted to the drill string 6 in such a way that it cannot be retrieved, i.e. a fixed mount tool. Alternatively, all or a part of the telemetry tool 40 can be retrievable from the drill string 6, i.e. a retrievable tool. Various means of mounting are possible. For example, the telemetry tool 40 can hang in a section of the BHA 7, referred to as a "top mount" configuration, or the telemetry tool 40 can rest on a section of the BHA 7, referred to as a "bottom mount". In either case, the telemetry tool 40 is contained in part of the BHA 7.

Figure 1C:
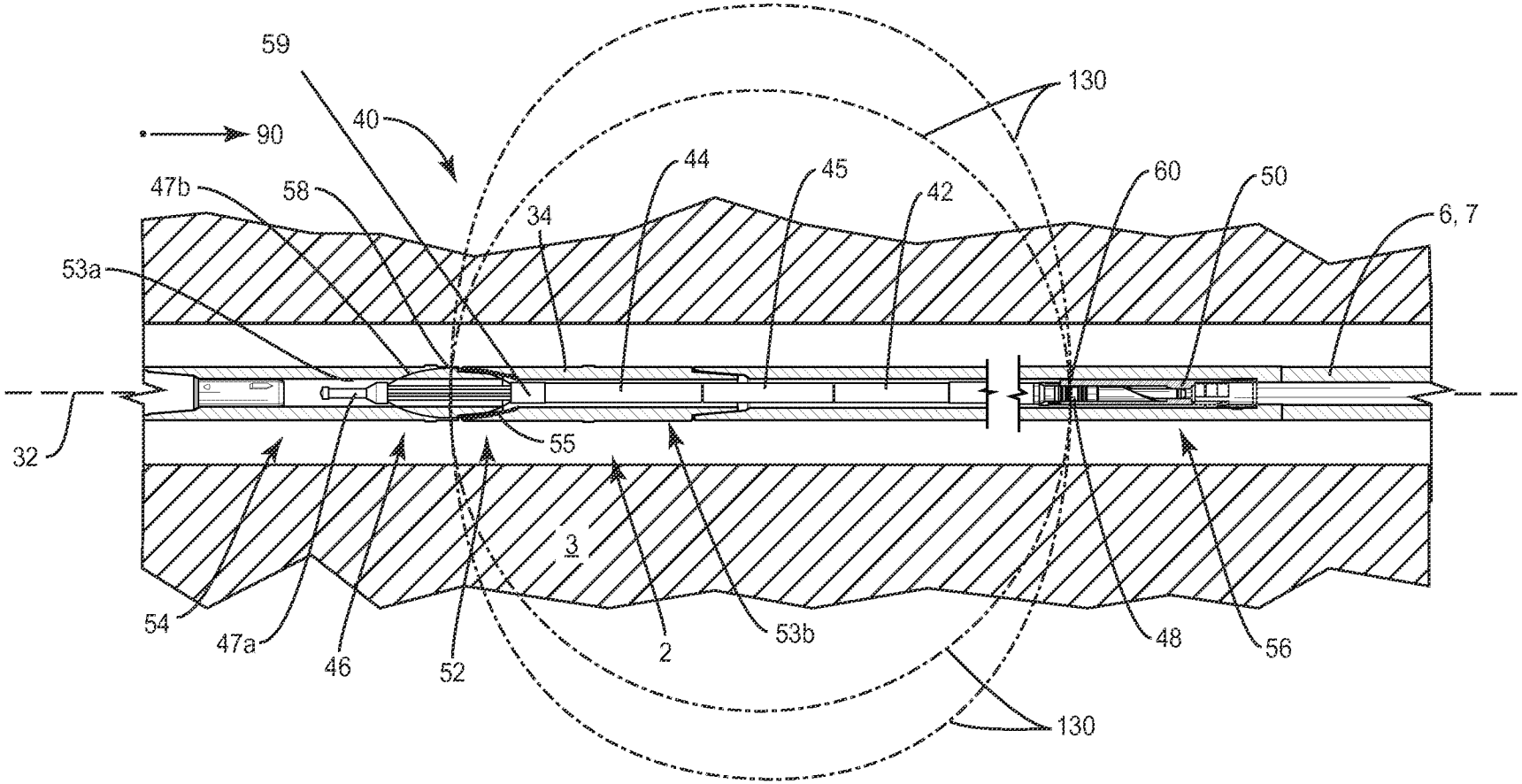
FIG. 1C is a detailed sectional view of a telemetry tool incorporated into the drilling system shown in FIG. 1A.

Turning to FIG. 1C, the telemetry tool 40 is configured to transmit drilling data to the surface 4. In the illustrated embodiment, the telemetry tool 40 includes an electrode assembly 46, a transmission assembly 44 and a power source 45. The electrode assembly 46 and transmission assembly 44 are electrically connected to the power source 45. The telemetry tool 40 includes an electrode insulator 59, commonly referred to as electrode gap, located where the electrode assembly 46 is attached to the transmission assembly 44. Telemetry tool 40 components will be further detailed below. The telemetry tool 40 is also electrically connected to one or more sensors 42 and various downhole circuitry (not numbered). The sensors 42 obtain drilling data and the telemetry tool 40 transmits the drilling data to the surface via the electromagnetic field signal 130. Further, the telemetry tool 40 illustrated in FIG. 1C can be supported by an orienting probe 48, which may be referred to as a stinger. The orienting probe 48 is configured to seat in a mule shoe 50 attached to an inner surface (not numbered) of the drill string 6. The orienting probe 48 seated in the mule shoe 50 orients, for instance, a directional sensor relative to the drill string 6, so that the directional sensor can obtain and provide directional measurements, such as the tool face. The orienting probe 48 supports one or more of the sensors 42, power source 45, transmission assembly 44 and electrode assembly 46 in the drill string 6.

Continuing with FIG. 1C, when the telemetry tool 40 is installed in the drill string 6 or part of the BHA 7 and used during a drill operation, the telemetry tool 40 extends along and with a gap sub 52, which is a component of the drill string 6 (or BHA 7). The gap sub 52 electrically isolates an uphole portion 54 of the drill string to a downhole portion 56 of the drill string 6. Thus, the gap sub 52 is located between the uphole portion 54 and the downhole portion 56. The gap sub 52 can include an upper gap sub portion 53*a* and a lower gap sub portion 53*b*. In the embodiment illustrated in FIG. 1C, the gap sub 52 includes an insulator 55 located between the upper gap sub portion 53*a* and the lower gap sub portion 53*b*. While a single gap sub 52 is shown, the gap sub 52 can include one or more gap subs, e.g. a dual gap sub. Regardless, the mating surfaces of gap sub components can be insulated. Typically, the threads and shoulders are insulated, but any means which electrically isolates a portion 34 of the drill string 6 can be used.

The electrode assembly 46 defines an electrode connection 58 with the drill string 6. In the illustrated embodiment, the electrode assembly 46 includes a shaft component 47*a* and a bow spring component 47*b*. The bow spring component 47*b* directly contacts the drill string so as to define an electrically conductive connection with the drill string 6 uphole from the insulator 55. Alternatively, the electrode assembly 46 can include a shaft component 47*a* and a contact ring assembly (not shown) used for fixed mount tools. In such an alternative embodiment, the contact ring defines an electrical connection between the electrode shaft 47*a* and drill string 6.

Accordingly, the telemetry tool 40 defines the first electrical or electrode connection 58 with the drill string 6. A downhole component, for instance the stinger 48 as illustrated, can define a second electrical or contact connection 60 with the drill string 6 that is spaced from the first electrical connection 58 along the central longitudinal axis 32. The second electrical connection 60 includes conductive electrical contact with the drill string 6 at a location that is spaced from the insulator 55 in the downhole direction 90. As illustrated, the stinger 48 can include a conductive element that defines the second electrical connection 60 with the mule shoe 50 and the drill string 6. The gap sub 52 thus extends between at least a portion of the first and second electrical connection 58 and 60. The electrode connection 58 is typically referred to in the art as a "gap plus" and the contact connection 60 is typically referred to in the art as the "gap minus."

The power source 45, which can be a battery or turbine alternator, supplies current to the transmission assembly 44, the electrode assembly 46, and sensors 42. The power source 45 is configured to induce a charge, or voltage across the drill string 6, between 1) the first electrical connection 58 defined by the electrode assembly 46 in contact with the drill string 6 above the insulator 55, and 2) the second electrical connection 60 located below the gap sub 52. When the power source 45 supplies a charge to the electrode assembly 46, the electrode shaft 47*a* conducts current to the first electrical connection 58 located above the insulator 55 in the gap sub 52. The electrode insulator 59 includes a passageway (not shown) that permits the delivery of current to the electrode shaft 47*a*. Further, the electrode insulator 59 is configured to block the current delivered to the electrode shaft 47*a* from flowing back into the transmission assembly 44. When the power source 45 induces the charge, the charge creates the electromagnetic field signal 130. The electric field component becomes positive or negative by oscillating the charge, which creates and causes an electromagnetic field signal 130 to emanate from the telemetry tool 40.

The transmission assembly 44 receives drilling data from the one or more sensors 42 and encodes the drilling data into a data packet. The transmission assembly 44 also includes a power amplifier (not shown) electrically connected to a modulator (not shown). The modulator modulates the data packet into the electromagnetic signal 130 created by the voltage induced across the telemetry tool 40 between the first and second electrical connections 58 and 60. It can be said that the data packet is embodied in the electromagnetic field signal 130. The power amplifier amplifies the voltage induced across the telemetry tool 40. In particular, the power amplifier (not shown) amplifies the electrical field component of the electromagnetic signal 130 such that electric field component of the signal 130 can propagate through the formation 3 to the surface 4 and is received by one or more of the antenna pairs 120*a*, 120*b*, and 120*c*. Alternatively, the transmission assembly 44 can be configured to amplify the magnetic field component of the electromagnetic field signal 130 as needed. As used herein, the electromagnetic field signal 130 can refer to the electrical field component of the signal or the magnetic field component of the signal.

As noted above, the telemetry tool 40 may be connected to one or more sensors 42. The one or more sensors may include directional sensors that are configured to measure the direction and inclination of the well path, and orientation of a tool in the drill string. The sensors can also include formation sensors, e.g. gamma sensors, electrical resistivity, and drilling information sensors, e.g., vibration sensors, torque, weight-on-bit (WOB), temperature, pressures, and sensors to detect operating health of the tool. Drilling data can include: directional data, such as magnetic direction, inclination of the borehole and tool face; formation data, such as gamma radiation, electrical resistivity and other measurements; and drilling dynamics data, including but not limited to, downhole pressures, temperatures, vibration data, WOB, torque. Further, while the BHA 7 may include one or more sensors 42 as noted above, additional downhole sensors may be located along any portion of the drill string 6 for obtaining drilling data. The additional downhole sensors can be in electronic communication with the telemetry tool 40 such that the drill data obtained from the additional downhole sensors can be transmitted to the surface 4. While the telemetry tool may connected to one or more sensors located along the drill string 6, some sensors may be integral to the tool 40. Further, one up to all of the sensors can also be electrically connected to a mud pulse telemetry system, as needed.

One or more telemetry system 100 parameters are adjustable during the drilling operation. Parameter adjustment can improve data acquisition and provide additional flexibility to monitor and adjust transmission settings based on signal characteristics. The telemetry tool 40 has an operating frequency between 2 Hz and 12 Hz, the operating frequency being adjustable during the drilling operation. It should be appreciated that the operating frequency can exceed 12 Hz in some embodiments, or be less than 1 Hz in other embodiments. The telemetry tool 40 is configured to have a data rate between 1 to 12 bits per second (bps). The data rate could be up to or exceed 24 bps. However, higher operating frequencies, such as operating frequencies instance well above 12 Hz, do not propagate well through formation strata and data rates are somewhat limited depending on the specific geology of the formation and depth of the transmission point. In any event, the data rate can be adjusted during the drilling operation. Further, the telemetry tool has an adjustable power output that could be as low as 1 W and up to or even exceed 50 W. In addition, the user can adjust data survey sequences, the data density for higher resolution formation logs, sequence of measurements according to needs of the drilling operation, and encoding methodology employed by the modulation device 114 (discussed below). The ability to adjust any one of the aforementioned parameters provides improves system flexibility for receiving and monitoring signal reception at the surface 4. Parameter adjustability, and the improved signal reception by decoding a signal from a particular antenna pair 102 with preferred signal reception characteristics enables the use of higher data rates that can be used with stronger signals. Thus the telemetry system 100 can provide more measurements, more data points for a particular measurement, or an optimum combination of measurements, in real-time, to the drill operator. Optimal real time measurements of downhole conditions enables the drilling operator to execute the drilling operation at hand efficiently. In addition, by constantly switching and selecting to the preferred signal, it is at times possible to drill deeper and still receive a usable signal at the surface. Lastly, utilizing the preferred signal enables transmitting at lower power levels thus reducing the consumption of batteries, typically the highest operating cost of a system. Any of the parameters discussed in this paragraph are exemplary. As an example of the type of telemetry tool employed in the telemetry system 100, the SureShot EM MWD system, as supplied by APS Technology, Inc.

Figure 1D:
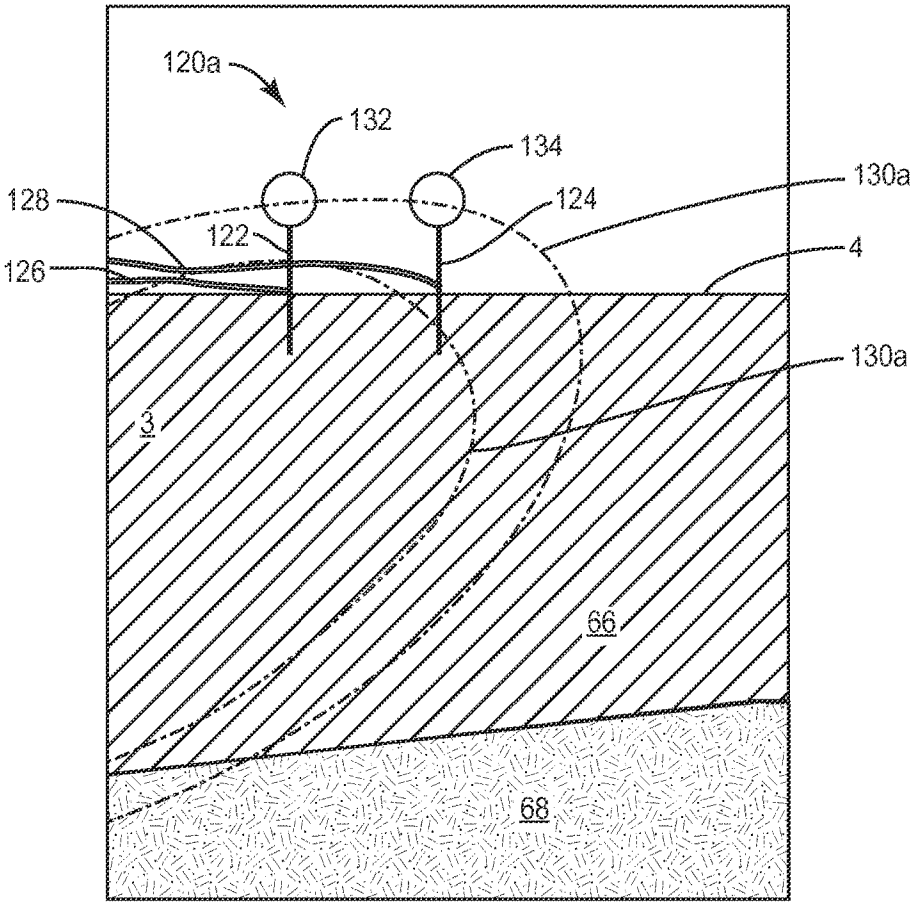
FIG. 1D is a detailed view of a portion of the drilling system shown in FIG. 1B.

Referring to FIGS. 1B, 1D and 2A, the telemetry system 100 includes the receiver assembly 110 and a plurality of antenna receiver pairs 120*a*, 120*b* and 120*c* each of which are electronically connected to the receiver assembly 110 through respective wired and/or wireless connections. While three antenna pairs 120*a*, 120*b*, and 120*c* are illustrated. At least two antenna pairs 120, up to four antenna pairs 120 or more can be used. In the depicted embodiment, the plurality of antenna pairs include a first pair of antennas 120*a* positioned at first location A on the surface 4, a second pair of antennas positioned at second location B on the surface 4 that is different from the first location, and a third pair of antennas 120*c* that is positioned on the surface at a third location C that is different than the first and second locations A and B. The first, second and third locations A, B, C are shown positioned along the surface 4 along the expected direction of drilling. Further, as detailed below, the first, second and third locations A, B, and C can correspond or are associated with locations of the telemetry tool 40 in the borehole 2. In the illustrated embodiment, the first antenna pair 120*a* is positioned closer to the support structure 5 than second and third locations B and C. During operation, an operator may pre-select one of the first, second, and third locations A, B, and C based on the expected drilling direction. The telemetry system can remove, or limit, the need to move the antenna pairs and the resulting loss of data as drilling progresses through the earthen formation 3. However, if needed, antenna pairs can be relocated. In some cases, obstructions and noise sources may necessitate locating one or more of the antenna pair off of the well path and the telemetry system 100 is beneficial even when the plurality of antenna pairs 120 are not located along an expect well path. Further, for vertical drilling operations, the antenna pairs 120 may be spaced apart around the derrick 5. For instance, the antenna pairs can be located at approximately equally spaced distances from the derrick 5 in multiple directions (not shown). For instance, although not depicted in the figures, a first antenna pair 120 can be located at a predetermined distance north of the derrick 5, another antenna pair can be located east of the derrick 5, a third antenna pair 120 can be located south of the derrick 5, and a fourth antenna pair can be located west of the derrick 5. The geographic directions are exemplary and used for illustrative purposes.

Turning to FIG. 1D, each antenna pair 120 includes a first receiver stake 122 and a second receiver stake 124. A receiver stake 122 and 124 can be any conductive element. In the illustrated embodiment, the receiver stakes 122 and 124 include terminals 132 and 134 respectively. Wires 126 and 128 connect the receiver stakes 122 and 124 to the receiver assembly 110, and to specific respective receivers in the receiver assembly 110, as discussed below. While wires 126 and 128 are shown, the antenna pairs can be configured to transmit the signals to the receiver assembly 110 wirelessly. The pair of terminals 132 and 134 receive or detect a first signal 130*a* as voltage or surface signal. The surface signal, is then received by the receiver assembly 110. In the illustrated embodiment, the first EM field signal 130*a* is transmitted from the telemetry tool 40A in a first downhole location 140A in the borehole 2 through formation strata 66 and 68 to the first antenna pair 120*a* positioned at location A along the surface 4 of the formation. The voltage signal detected by the antenna pair 120*a* is a first surface signal. Thus, the second antenna pair 120*a* can detect the electric field signal as a second surface signal. The third antenna pair 120*c* can detect the electric field signal as a third surface signal. Preferably, each antenna pair 120 is a conventional antenna pair used in drilling telemetry. It should be noted that the antenna pairs 120 can be defined by other configurations than a pair of receiver stakes 122 and 124 as illustrated. As noted above, the antenna pair 120 can be defined by any two electrically conductive components. For instance, the antenna pair 120 can include a single receiver stake 122 and the casing 12 (FIG. 1B) or blowout preventer (BOP) (not shown). That is, the receiver assembly 110 can be connected to the first receiver stake 122 via a first wired connection and to the casing 12 via a second wire connection. In such an embodiment, the casing 12 becomes a receiver element such that the casing 12 and receiver stake 122 define the antenna pairs 120. Further, the antenna pair can include the casing 12 and any other electrically conductive component.

Returning to FIGS. 1B and 2A, the receiver assembly 110 receives the first, second and third surface signals from respective antenna pairs 120*a*, 120*b*, and 120*c*. The receiver assembly 110 thus includes multiple receivers. Each receiver in the receiver assembly 110 may be referred to an amplifier 112. Thus, the receiver assembly 110 can at least two amplifiers 112, up to as many amplifiers as there are antenna pairs 120. The receiver assembly 110 can include one or more demodulation devices 114. The amplifier 112 may be a power amplifier used to detect the minute voltages received by the antenna pair 120 and increase the voltage to usable levels. At useable levels, the surface signal can be separated from background voltage or noise in later signal processing. The demodulation device 114 is in electronic communication with the computing device 200. It should be appreciated that the portion of the computing device 200 can be contained in the receiver assembly 110, such as a processor. In operation, as noted above, each antenna pair 120*a*-120*c* detects an electric field component of the EM signal 130 propagated by the telemetry tool 40 as a change in voltage potential across the terminal ends 132 and 134. The voltage potential across the terminal ends 132 and 134 of receiver stakes 122 and 124 refers to a surface signal as used herein. The respective amplifier 112 detects the surface signal and increases the amplitude of the surface signal received from its respective antenna pair 120. The receiver assembly 110 can therefor monitor, or detect, a surface signal from each antenna pair 120. For instance, if there are four separate antenna pairs 120, four amplifiers 112 detect each respective surface signal of the antenna pair 120. In this way, the telemetry system 100 can monitor multiple surface signals simultaneously in real time as the drilling operation progresses. At this point, the computing device 200 can cause the amplified surface signals to be displayed via the user interface, for instance on a computer display (not shown).

The demodulation device 114 can decode the data packet carried by the surface signals. In an embodiment, the demodulation device 114 and processor (in the computing device 200 can demodulate the surface signal first into binary data. Then, the binary data is sent to the processing portion of the computing device 200. The binary data is then further processed into drilling information that is then stored in computer memory for access by other software applications, for instance, vibration analysis operations, logging display application, etc. Alternatively, the demodulation device 114 and a processor in the receiver assembly 110 can decode the signal into binary data and process the binary data into drilling information or data. Thus, it should be appreciated that the receiver assembly 110 can be configured to detect, amplify and decode the surface signal with the preferred characteristics. Alternatively, the receiver assembly 110 can be configured to detect and amplify each surface signal, and then transmit the amplified surface signals to the computing device 200 (external to the receiver assembly 110) for decoding. In such an embodiment, the computing device 200, via the processing portions, carries out instructions stored on the computer memory, to decode only one of the amplified signals which has the preferred signal characteristics. Decoding can occur automatically as discussed above, or in response to a command to do so from a drilling operator. In the illustrated embodiment, the demodulation device 114 and/or processor (not shown) decodes only the surface signal among the plurality of surface signals based on a determination of the characteristics of electric field component of the EM signal 130 detected by the antenna pairs 120*a*, 120*b*, and 120.

Accordingly, while the telemetry system 100 facilities monitoring multiple signals that are indicative of the electric field component of the EM signal 130 detected by multiple respective antenna pairs 120, the telemetry system 100 decodes, among the plurality of surface signals received by the receiver assembly 110, only one surface signal into drilling data. Such a system results in real time observations signal quality from multiple locations simultaneously. Further, as noted above, the telemetry system 100 can allow the drilling operator to utilize the best or preferred quality signal detected among the multiple antenna pair locations. Further, monitoring of multiple signals, as well as the ability to adjust one or more telemetry parameters, allows the drilling operator to tailor the transmission needs, frequency, power input, to specific data acquisition requirement given well path, formation characteristics, and noise. For instance, power input can be lowered to reduce conserve power resource. Conserving power utilizes power sources more efficiently which could allow the drilling operator to finish the bit run and avoid a costly trip out of the hole to replace a power source.

At the onset of a drilling operation, the telemetry tool 40A and drill bit 14A are located at a first downhole location 140A in the borehole 2 during a first duration of the drilling operation. The first downhole location 140A can be associated with the first location A of the antenna pairs 102*a* on the surface 4. The telemetry tool 40 generates the electromagnetic field 130*a* (with data packet encoded therein) and travels through formation strata 66 and 68 toward the surface 4. The electric field component of the EM signal 130 is received, for instance detected, by the first antenna pair 120*a*. The electromagnetic signal 130*a* can be referred to as a first EM field signal 130*a*. The electric filed component of the EM signal 130*a* could be detected by the second antenna pair 120*b* as well, though the signal characteristics detected by the second antenna pair 120*b* may be less preferred than the electric field signal detected by the first antenna pair 120*a*. It should be appreciated that the downhole location of the telemetry tool 40 during the drill operation is not required to be directly beneath the location A along the vertical direction V. As the first EM field signal 130*a* travels through the formation 3, formation strata, noise from the derrick 5, motors, metallic components, underground utilities transmission lines, impacts the electric field component and reduces the detectable signal at the surface 4. Formation strata can be favorable or unfavorable to signal transmission to varying degrees. As the well progresses it may pass through or under formation strata which have different degrees of favorability for signal transmission and reception. This constantly changing environment may require frequent adjustments to the location of the antennas (in conventional system) and operating parameters. Further, background electrical noise may come and go according to surface activities. By being able to observe signal quality in real time from multiple locations via antenna pairs 120, and switching among the antenna pair locations for optimum signal quality in a timely manner is beneficial.

As drilling progresses, the borehole 2 changes orientation from a more vertical direction V into a more horizontal direction H. Thus, during a second duration of the drilling operation that is subsequent to the first duration of the drilling operation, the telemetry tool 40 can generate a second EM field signal 130*b* that emanates from the telemetry tool 40 located at the second downhole location 140B in the borehole 2 that is downhole with respect to the first downhole location 140A. When the telemetry tool 40 is at the second downhole location 140B, the second EM field signal 130*b* travels through formation strata 62, 64, 66, and 68 toward the surface 4. The second EM field signal 130*b* is detected by the antenna pairs 120*b* and 120*c*. Thus, the downhole location 140B is located at a greater depth from the surface 4 than the downhole location 140A. As noted above, the electromagnetic signal 130*b* attenuates as the electromagnetic 130*b* emanates from the telemetry tool 40 and travels to the surface 4.

As the electromagnetic field signal 130*b* approaches the surface 4, noise and the formation strata, impacts the electromagnetic signal and degrades the detectable signal at the antenna pairs 120*a*, 120*b* and/or 120*c*. Depending on the location of the antenna pair relative to the telemetry tool 40 in the borehole 2, for instance, the antenna pair 120*b* may receive and detect the electric field component of the signal 130*b* with a lower (worse) signal to noise ratio compared to the signal to noise ratio of the electric field component of the signal 130*b* detected by antenna pair 120*c* because at 120*c* the signal 130*b* passes through a thinner part of an unfavorable strata 68. In operation, because the surface signals of each respective antenna pairs 120*a*, 120*b*, and 120*c*, which are indicative of the electric field component of the second EM signal 130*b*, are displayed via the computer display, a drilling operator has real-time visual indication of the relative strength of the electric field signal detected at each antenna pair. The operator can cause the computing device 200 to decode, via the demodulation device 114, only that surface signal that has preferred signal characteristics. Alternatively, the computing device 200, running software stored on the memory portion, causes the processor to determine signal characteristics for each signal received from each antenna pair 120*a*, 120*b*, and 120*c*. On the basis of the preferred signal characteristics, the computing device 200 causes the demodulation device 114 to automatically decode the surface signal with the preferred signal characteristics into drilling data that can be used with one or more software applications to monitor and control the drilling operation.

Whether one or more of the antenna pairs detect the first EM field signal 130*a* or the second EM field signal 130*b*, the electric field signal detected by the first and second pair of antennas have respective first and second signal characteristics. The system, apparatus and method as described herein can identify which of the first and second signal characteristics the electric field signal detected by the respective first and second pairs of antennas is a preferred signal characteristic. Thus, only the surface signal detected or monitored by only one of the pair of antennas 120*a*, 120*b*, 120*c* that detected the electric field signal with the preferred signal characteristic is decoded, as further detailed below.

Figure 3A:
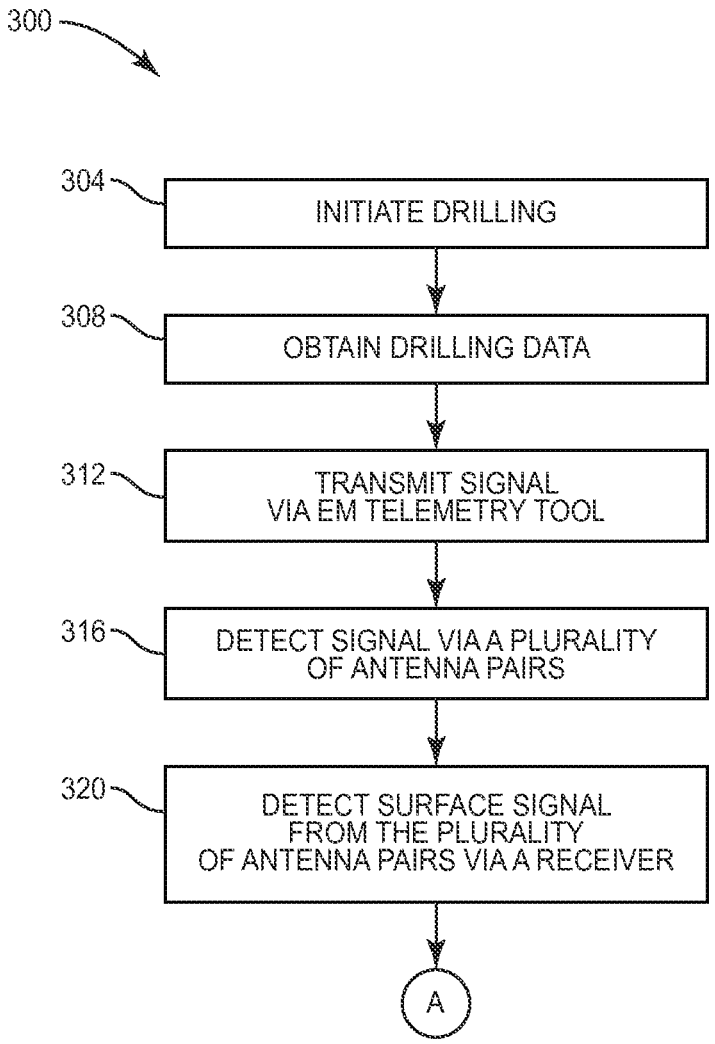
FIGS. 3A and 3B is process flow diagram illustrating a method for monitoring a drilling operation via the telemetry system shown in FIGS. 1A and 1B.
Figure 3B:
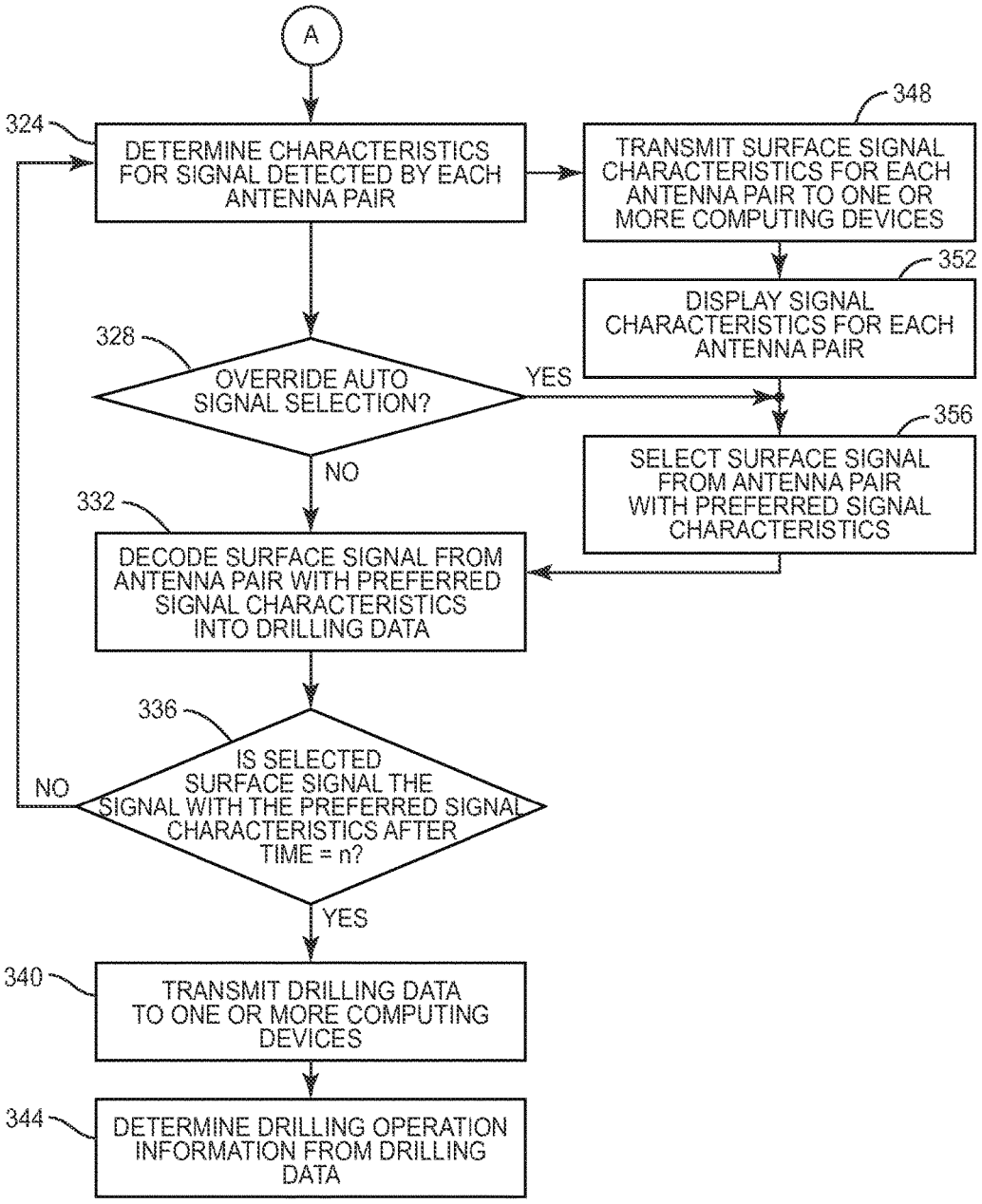

Referring to FIGS. 3A and 3B, an exemplary method 300 for monitoring and controlling a drilling operation via the telemetry system 100 and EM telemetry tool 40 is shown. In accordance with the embodiment of the method 300 illustrated in FIGS. 3A and 3B, the method including monitoring and decoding a surface signal detected by each antenna pair 120 based on one or more preferred signal characteristics. Thus, the method 300 contemplates monitoring the electrical field component of the EM signal 130 based on a signal-to-noise ratio. Other signal characteristics, including but not limited to, frequency variance, presence of harmonics, and frequency stability, and others may be used as well. In step 304, drilling is initiated. For instance, the operator causes the motor to rotate the drill string 6 and initiates mud flow in the drill string 6, which causes the drill bit 14 to rotate. As the drill bit 14 rotates, the drill string 6 is advanced along the downhole direction. In step 308, the telemetry tool 40, via the one or more sensors 42, obtains drilling data. In step 312, the telemetry tool 40 transmits the drilling data to the surface 4 via electromagnetic field signal 130. As noted above, the telemetry tool 40, via the transmission assembly 44, modulates the drilling data in the signal. The transmission assembly 144 is configured to carry out modulation of the drill data. The modulation selected should account for bandwidth efficiency, noise error performance, modulation efficiency, and energy consumption requirements. Modulation types, as quadrature phase-shift keying (QPSK), binary phase-shift keying (BPSK) and frequency-shift keying (FSK), can be suitable EM telemetry in drilling operations. Other modulation methods can be used as needed.

In step 316, one or more up to all of the plurality of antenna pairs 120*a*-120*c* detect the signal 130. The antenna pairs 120 detect the signal as an alternating voltage indicative of a waveform. The waveform embodies the data packet encoded into the signal 130 downhole. The voltage detected by the antenna pairs 120 is referred to as a surface signal, as noted above. In turn, in step 320, the receiver assembly 110 receives the surface signal from each respective antenna pair 120*a*, 120*b*, or 120*c*. As noted above, more than three pairs of antennas 120 can be used. Process control is then transferred to step 324 (FIG. 3B), whereby the process determines characteristics for the surface signal detected by each antenna pair 120. When signal characteristics are determined, process control can be transferred to step 348. In step 348, the signal characteristics for each antenna pair are transmitted to the computing device 200. Alternatively, the computing device 200 can access the determined signal characteristics. Process control is then transferred to step 352. In step 352, the computing device 200 causes the display of the signal characteristics via graphical user interface on a computer display. In step 356, the user can cause the selection of the signal detected by the antenna pair with the preferred signal characteristics, then process control is then transferred to step 332.

Returning to step 324, process control can also be transferred to step 328, whereby the processor determines if automatic signal selection has been overridden. For example, the user may want to select which surface signal should be decoded. The processor determines if the operator has 1) manually selected a surface signal with the preferred signal characteristics, or 2) has indicated that auto signal selection is not needed. If there is an automatic signal override, process control is transferred to step 356 described above. If there has not been an automatic signal override, process control is transferred to step 332.

In step 332, the selected surface signal with the preferred signal characteristics is decoded into drilling data. The processor can cause the demodulation device 114 to decode the surface signal received from the antenna pair that has detected the signal with the preferred signal characteristics. For instance, if the surface signal from antenna pair 120*b* has preferred signal characteristics over the surface signal received from antenna pair 120*c*, then the demodulation device 114 will decode the surface signal received from antenna pair 120*c*. As noted above, decoding can include two phases: 1) processing the data packet into binary data, and 2) processing binary data into drilling information. Either decoding phase, or both decoding phases, can be carried out via processor housed in the receiver assembly 110. Alternatively, either decoding phase, or both decoding phases, can be carried out via processor housed in the computing device 200.

In step 336, the processor will continuously determine which surface signal has the preferred signal characteristics over a period of time (t). The period of time (t) can be very short. As the drill string 6 advances through the formation 3, the antenna pair 120*b* receives a surface signal with the preferred signal characteristics. Over time, however, antenna pair 120*c* detects the signal 130 with preferred signal characteristics over the signal as detected from antenna pair 120*b*. Thus, if the selected surface signal is the surface signal with the preferred signal characteristics, process control is transferred to step 340. If the selected surface signal is no longer the surface signal with the preferred signal characteristics, process control is transferred to step 323.

In step 340, the decoded signal is transmitted to the computing device 200 or portions thereof. In step 344, the computing device 200, via one or applications hosted thereon, determines drilling operation information from the decoded drilling data.

Figure 4:
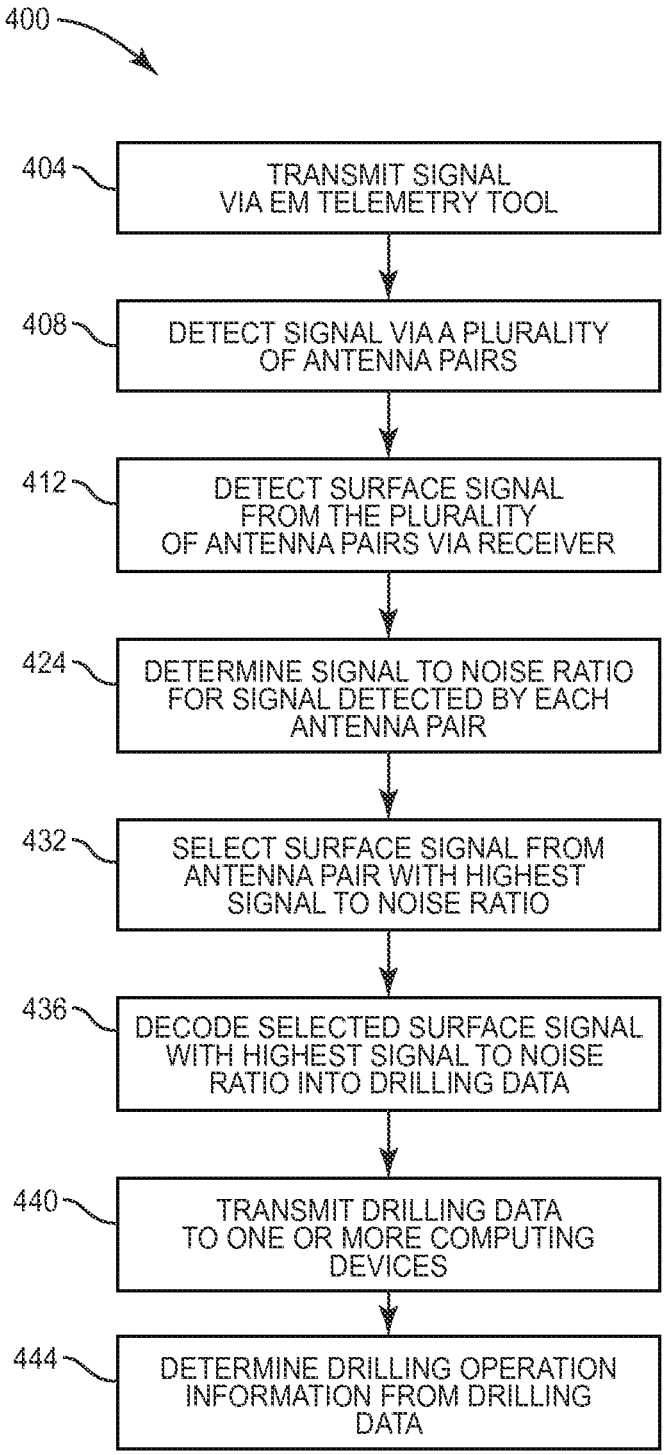
FIG. 4 is process flow diagram illustrating a method for monitoring a drilling operation of the drilling system via the telemetry system, according to another embodiment of the present disclosure.

Referring to FIG. 4, an alternate embodiment of a method for monitoring and controlling a drilling operation is illustrated. In accordance with the embodiment of the method 400 illustrated in FIG. 4, the method 400 includes monitoring and decoding a surface signal detected by each antenna pair 120 that has the highest signal to noise ratio. Thus, the method 400 contemplates monitoring the electromagnetic signal 130 based on the signal-to-noise ratio as basis to determine which signal to decode. Similar to the method 300 described above and shown in FIGS. 3A and 2B, the method 400 includes initiating drilling (not shown) and obtaining drilling data from the one or more sensors 42. Further, steps 404 through 412 are similar to the method 300 as described above. In step 404, the telemetry tool 40 transmits drilling data to the surface 4 via electromagnetic field signal 130. In step 408, each of the plurality of antenna pairs 120 receive the signal. In step 412, the receiver assembly 110 receives the surface signal from each antenna pair 120.

In accordance with the alternate embodiment, in step 424, the process determines the signal to noise ratio for each signal received from the antenna pairs 120. In step 432, the surface signal from the antenna pair that detects the signal 130 with the highest signal to noise ratio is selected. Either the user can select the signal with the highest signal to noise ratio or the processor can automatically select the signal with the highest signal to noise ratio. For instance, the method 400 can also include a manual override detection step, similar to step 328 discussed above. In step 436, the selected surface signal is decoded. The processor can cause the demodulation device 114 to decode the surface signal received from the antenna pair that has received the signal with the highest signal to noise ratio. In step 440, the decoded signal is transmitted to the computing device 200 or a processor included in the receiver assembly 110. In step 440, the computing device 200 determines the drilling operation information from the decoded drilling data as discussed above. The method 400 can also include the step of displaying each surface signal via display (not shown).

In accordance with another embodiment of the present disclosure, the telemetry system 100 can be configured to downlink information from the surface 4 to the tool located downhole, such as the telemetry tool 40. The downlink telemetry system 100 (not shown) when configured for downlinking data to the telemetry tool 40, can include a receiver assembly 510 (not shown) and plurality of antenna pairs 520 (not shown), similar to the embodiment described above. However, in accordance with the alternate embodiment, the receiver assembly 110 can be housed in a downhole tool telemetry tool 40 or some other tool or drill string component. Further, the plurality of antenna pairs 520 can be positioned along the drill string 6. At the surface 4, the downlink telemetry system 100 can include a transmitter 544 (not shown). For instance, the transmitter 544 can be included in the receiver assembly 110 or can be a separate unit. The transmitted is configured to encode data received from a source, such as sensors or a computing device, into an electromagnetic field signal that propagates into the formation. The receiver assembly 210 and plurality of antenna pairs 520 will function in similar manner to receiver assembly 110 and plurality of antenna pairs 520 described above.

What is claimed:

1. A method for monitoring a drilling operation of a drilling system, the drilling system having a drill string having a top end located at a surface of an earthen formation, the drill string configured to form a borehole in the earthen formation during the drilling operation, the method comprising the steps of:

transmitting an electromagnetic signal via an electromagnetic telemetry tool located at a downhole end of the drill sting while the electromagnetic telemetry tool is in the borehole;

receiving the electromagnetic signal transmitted by the electromagnetic telemetry tool via a first pair of antennas positioned on the surface of the earthen formation, the first pair of antennas being spaced apart from the top end of the drill string, wherein the electromagnetic signal received by the first pair of antennas has a first signal characteristic at the surface;

receiving the same electromagnetic signal transmitted by the electromagnetic telemetry tool via a second pair of antennas each of which are different from each of the first pair of antennas, the second pair of antennas being positioned on the surface at a different location at a distance further away than that of the first pair of antennas with respect to the top end of the drill string, wherein the electromagnetic signal received by the second pair of antennas has a second signal characteristic at the surface at the different location;

receiving via a receiver assembly a first surface signal transmitted from the first pair of antennas and a second surface signal transmitted from the second pair of antennas, wherein the first surface signal has the first signal characteristic and the second surface signal has the second signal characteristic;

identifying via a computer processor if a) the first signal characteristic of the first surface signal received by the first electromagnetic antenna pair or b) the second signal characteristic received by the second electromagnetic antenna pair has a preferred signal characteristic; and decoding the first surface signal or the second surface signal transmitted by the respective first pair of antennas and the second pair of antennas with the preferred signal characteristic, wherein the first signal characteristic and the second signal characteristic include a strength of the electromagnetic signal received by the antenna pairs respectively.

2. The method of claim 1, wherein the receiver assembly includes a first receiver and a second receiver, the first receiver in electronic communication with the first pair of antennas and the second receiver in electronic communication with the second pair of antennas, wherein the method comprises the steps of:

receiving, via the first receiver, the first surface signal; and receiving, via the second receiver, the second surface signal.

3. The method of claim 1, further comprising the step of selecting, via a user interface running on a computing device, the one of the first and second surface signals received from one of the first and second pairs of antennas that has the preferred signal characteristic such that the selected one of the first and second surface signals is decoded in the decoding step.

4. The method of claim 1, wherein the step of decoding comprises automatically decoding the one of the first and second surface signals received by the receiver assembly from one of the first and second pairs of antennas that has received the electromagnetic signal with the preferred signal characteristic.

5. The method of claim 1, wherein the strength of the electromagnetic signal is a signal to noise ratio with respect to the signal strength of the electromagnetic signal received by the respective antenna pair, wherein the step of decoding further comprising decoding the one of the first and second surface signals transmitted by one of the first and second pairs of antennas that has received the electromagnetic signal with the highest signal to noise ratio.

6. The method of claim 1, further comprising the steps of:

obtaining drilling data via one or more sensors carried by the drill string; and transmitting the drilling data to the surface via the electromagnetic signal.

7. The method of claim 1, wherein the receiver assembly includes a processor, wherein the decoding step is executed by the processor of the receiver assembly.

8. The method of claim 1, wherein a computing device includes a processor, wherein the decoding step is executed by the processor of the computing device.

9. The method of claim 1, wherein the receiver assembly includes a first processor, and the decoding step is executed by the first processor of the receiver assembly and a second processor of a computing device.

10. The method of claim 1, further comprising the steps of:

determining that the other one of the first and second pair of antennas has received the electromagnetic signal with the preferred signal characteristics; and causing the first or second surface signal transmitted by the other one of the first and second pair of antennas to be decoded.

11. The method of claim 1, further comprising the step of adjusting one or more telemetry parameters in response to the identifying step, the one or more telemetry parameters including power input, frequency, data rate, and modulation method.

12. The method of claim 1, further comprising the steps of; receiving the electromagnetic signal via a third pair of antennas positioned on the surface at another different location than the first and second pairs of antennas, the first, second, and third pair of antennas being spaced apart on the surface with respect to each other, wherein the electromagnetic signal received by the third pair of antennas has a third signal characteristic;

receiving via, the receiver assembly, a third surface signal transmitted from the third pair of antennas, wherein the third surface signal has the third signal characteristic; and decoding one of the first, second, and third surface signals transmitted by one of the respective first, second and third pairs of antennas that has received the electromagnetic signal with the preferred signal characteristic.

13. The method of claim 1, wherein the one surface signal with the preferred signal characteristic is the surface signal with the highest signal to noise ratio.

14. The method of claim 13, wherein each one of the first and second surface signals is an electrical field component of the electromagnetic signal.

15. The method of claim 1, wherein the first pair of antennas is positioned at a first surface location that is spaced from the drill string a first distance, and the second pair of antennas is positioned at a second surface location that is spaced from the drill string a second distance, wherein the first distance is different than the second distance.

16. The method of claim 1, wherein the electromagnetic signal received by the first pair of antennas is detected as a voltage potential between each antenna of the first pair of antennas, and the electromagnetic signal received by the second pair of antennas is detected as a voltage potential between each antenna of the second pair of antennas.

17. The method of claim 1, wherein the first pair of antennas includes a first antenna and second antenna, and the second pair of antennas includes a third antenna and a fourth antenna.

18. A method for monitoring a drilling operation of a drilling system, the drilling system having a drill string having a top end located at a surface of an earthen formation, the drill string configured to form a borehole in an earthen formation during the drilling operation, the method comprising the steps of:

transmitting an electromagnetic signal from an electromagnetic telemetry tool on a drill string located at a first downhole location in the borehole during a first duration of the drilling operation;

receiving the electromagnetic signal transmitted by the electromagnetic telemetry tool via at least two antenna pairs during the first duration of the drilling operation, the at least two antennas pairs being spaced apart a distance with respect to each other and with respect to the top end of the drill string, wherein each antenna pair has a first antenna and a second antenna respectively, wherein each antenna pair is configured to detect a voltage potential of the electromagnetic signal via the respective antenna pairs;

receiving, during the first duration of the drilling operation, a respective surface signal from each of the at least two antenna pairs that received the electromagnetic signal from the electromagnetic telemetry tool; and after receiving the surface signal from each at the at least two antenna pairs, decoding one of the surface signals transmitted from one of the at least two antenna pairs that received the electromagnetic signal having a preferred signal characteristic, wherein the respective surface signal include a strength of the electromagnetic signal received by the antenna pairs respectively.

19. The method of claim 18, wherein the at least two antenna pairs is a first set of antenna pairs and a second set of antenna pairs, the electromagnetic signal is a first electromagnetic signal, further comprising the step of:

during a second duration of the drilling operation that is subsequent to the first duration of the drilling operation, transmitting a second electromagnetic signal from the electromagnetic telemetry tool at a second downhole location in the borehole that is downhole with respect to the first downhole location;

receiving the second electromagnetic signal via the second set of antenna pairs that are different than the first set of antenna pairs that received the first electromagnetic signal during the first duration;

receiving, during the second duration of the drilling operation, a respective second surface signal from each of the second set of antenna pairs that received the second signal; and decoding one of the second surface signals transmitted by one of second set of antenna pairs that received the electromagnetic signal having a second preferred signal characteristic.

20. The method of claim 18, wherein each surface signal received from the at least two antenna pairs is received by a respective at least two receivers of a receiver assembly.

21. The method of claim 18, further comprising:

selecting the one of the surface signals received from one of the at least two antenna pairs that has the preferred signal characteristic; and causing the selected surface signal to be decoded.

22. The method of claim 18, further comprising the steps of:

obtaining drilling data via one or more sensors carried by the drill string; and transmitting the drilling data to the at least two antenna pairs via the electromagnetic signal.

23. The method of claim 18, further comprising the step of displaying, via a display, the electromagnetic signal respectively received by each of the at least two antenna pairs.

24. The method of claim 18, wherein the one of the surface signals with the preferred signal characteristic is the surface signal with the highest signal to noise ratio with respect to the signal strength of the electromagnetic signal received by the respective antenna pair.

25. The method of claim 24, wherein the surface signal is an electrical field component of the electromagnetic signal.

26. The method of claim 18, wherein the at least two antenna pairs includes a first set of antenna pairs and a second set of antenna pairs, the first set of antenna pairs including a first antenna and a second antenna, and the second set of antenna pairs including a third antenna and a fourth antenna.

27. A telemetry system for a drilling operation that includes a drill string having a top end at the surface, the drill string configured to form a borehole in an earthen formation, the system comprising:

a telemetry tool that is configured to transmit an electromagnetic signal;

a plurality of antenna pairs with each antenna pair having different antennas with respect to each other and to other antenna pairs, each antenna pair configured to receive the electromagnetic signal that is transmitted from the telemetry tool at a downhole location in the borehole during the drilling operation, wherein each antenna pair is configured to receive the electromagnetic signal as a voltage potential between each antenna of the of antennas, and each antenna pair is spaced a distance with respect to each other and from the top end of the drill string;

a receiver assembly configured for electronic connection with each of the plurality of antenna pairs, the receiver assembly configured to receive a plurality of surface signals from each of the respective plurality of antenna pairs when the receiver assembly is electronically connected to the plurality of antenna pairs, wherein each surface signal is indicative of characteristics of the electromagnetic signal received by the respective plurality of antenna pairs; and a computer processor configured for electronic communication with the receiver assembly, the computer processor configured to a) determine which one surface signal among the plurality of surface signals has a preferred signal characteristic, and b) in response to and after the determination of the one surface signal among the plurality of surface signals that has the preferred signal characteristic, decode the one surface signal transmitted by one antenna pair of the plurality of antenna pairs that received the electromagnetic signal with the preferred signal characteristic, wherein each of the surface signals include a strength of the electromagnetic signal received by the respective antenna pairs.

28. The system of claim 27, wherein the telemetry tool is a measure-while-drilling (MWD) tool or a logging-while-drilling (LWD) tool.

29. The system of claim 27, wherein the computer processor is configured to automatically decode the one surface signal of the plurality of surface signals received from the plurality of antenna pairs that has received the electromagnetic signal with the preferred signal characteristic.

30. The system of claim 29, wherein the preferred signal characteristic is a signal to noise ratio with respect to the signal strength of the electromagnetic signal received by the respective antenna pair, wherein the computer processor is configured to automatically decode the one surface signal transmitted by one of the plurality of antenna pairs that has received the electromagnetic signal with the highest signal to noise ratio.

31. The system of claim 27, wherein the receiver assembly includes a respective receiver for each of the plurality of antenna pairs, each respective receiver configured to be in electronic communication with a respective pair of antennas.

32. The system of claim 27, wherein the receiver assembly includes the computer processor.

33. The system of claim 27, wherein the plurality of antenna pairs are configured to receive at least one of an electric field component of the electromagnetic signal and a magnetic field component of the electromagnetic signal.

34. The system of claim 33, wherein the receiver assembly is configured to receive at least one of the electric field component of the plurality of surface signals and a magnetic field component of the plurality of surface signals.

35. The telemetry system of claim 34, wherein each antenna pair is an electronic field antenna pair that is configured to receive the electrical field component of the electromagnetic signal.

36. The telemetry system of claim 35, wherein the receiver assembly is configured to receive the electric field component of the plurality of surface signals.

37. The telemetry system of claim 36, wherein the one surface signal with the preferred signal characteristic is the one surface signal with the highest signal to noise ratio with respect to the strength of the electromagnetic signal received by the respective antenna pair.

38. The system of claim 27, wherein the plurality of antenna pairs includes a first set of antenna pairs and a second set of antenna pairs, the first set of antenna pairs including a first antenna and a second antenna, and the second set of antenna pairs including a third antenna and a fourth antenna.

39. A drilling system for drilling a borehole in an earthen formation, the drilling system including a support member positioned on a surface of the earthen formation, the drilling system comprising:

an electromagnetic telemetry tool configured to be supported along a drill string carried by the support member wherein the electromagnetic telemetry tool is configured to transmit drilling data obtained by one or more or sensors via an electromagnetic signal;

a first pair of electromagnetic antennas configured to receive the electromagnetic signal as a voltage potential between each antenna of the first pair of electromagnetic antennas, wherein the first pair of electromagnetic antennas are configured such that they are spaced at a distance from the support member on the surface;

a second pair of electromagnetic antennas configured to receive the electromagnetic signal as a voltage potential between each antenna of the second pair of electromagnetic antennas, wherein each one of the second pair of electromagnetic antennas is different from each one of the first pair of electromagnetic antennas, wherein the second pair of electromagnetic antennas are configured such that they are spaced from the first pair of electromagnetic antennas and the support member;

a receiver assembly electronically connected to the first and second pair of electromagnetic antennas, the receiver assembly configured to receive first and second surface signals from each of the first and second pair of electromagnetic antennas, respectively, the first and second surface signals being indicative of the electromagnetic signal received by each of the first and second pair of electromagnetic antennas, respectively, wherein the first surface signal has a first signal characteristic and the second surface signal has a second signal characteristic, the first and second signal characteristics are indicative of characteristics of the electromagnetic signal received by the first and second electromagnetic antenna pairs, respectively; and at least one computer processor configured to a) identify which of the first signal characteristic and the second signal characteristic has a preferred signal characteristic, and b) in response to and after that identification, decode one of the first and second surface signals transmitted by one of the first and second pair of electromagnetic antennas, respectively, that received the electromagnetic signal with the preferred signal characteristic, wherein the first signal characteristic and the second signal characteristic include a strength of the electromagnetic signal received by the antenna pairs respectively.

40. The system of claim 39, wherein the at least one computer processor is configured to automatically decode the one of the first and second surface signals transmitted by one of the first and second pair of antenna pairs, respectively, that received the electromagnetic signal with the preferred signal characteristic.

41. The system of claim 39, wherein the preferred signal characteristic is a signal to noise ratio, wherein the at least one computer processor is configured to automatically decode the one of the first and second surface signals received by one of the first pair of electromagnetic antennas and the second pair of electromagnetic antennas that has received the electromagnetic signal with the highest signal to noise ratio.

42. The system of claim 41, wherein the electromagnetic telemetry tool is a measure-while- drilling (MWD) tool or a logging-while-drilling (LWD) tool.

43. The system of claim 39, further comprising a third pair of electromagnetic antennas configured for electrical connection with to the receiver assembly, wherein the first, second, and third pair of electromagnetic antennas are spaced apart on the surface with respect to each other and the borehole.

44. The drilling system of claim 39, wherein the one of the first and second surface signals with the preferred signal characteristic is the one of the first and second surface signals with the highest signal to noise ratio.

45. The drilling system of claim 44, wherein the first and second antenna pairs are first and second electronic field antenna pairs, such that, the first and second antenna pairs are configured to receive an electrical field component of the electromagnetic signal.

46. The drilling system of claim 45, wherein the receiver assembly is configured to receive the electric field component of the plurality of surface signals.

47. The system of claim 39, wherein the first pair of antennas includes a first antenna and a second antenna, and the second pair of antennas includes a third antenna and a fourth antenna.

* * * * *